US007360258B2

(12) United States Patent
Jaye et al.

(10) Patent No.: US 7,360,258 B2
(45) Date of Patent: Apr. 22, 2008

(54) HEADGEAR WITH INTEGRATED HAIR SHIELDING MECHANISM

(75) Inventors: Kerri Jaye, San Jose, CA (US); Susan Smith, Lafayatte, CA (US)

(73) Assignee: Liquid Mountain LLC, San Jose, CA (US)

( * ) Notice: Subject to any disclaimer, the term of this patent is extended or adjusted under 35 U.S.C. 154(b) by 0 days.

(21) Appl. No.: 11/375,676

(22) Filed: Mar. 14, 2006

(65) Prior Publication Data

US 2006/0206984 A1 Sep. 21, 2006

Related U.S. Application Data

(60) Provisional application No. 60/663,802, filed on Mar. 21, 2005.

(51) Int. Cl.
*A42B 1/20* (2006.01)

(52) U.S. Cl. ..... 2/209.3; 2/171.1; 2/171.5; 2/184.5

(58) Field of Classification Search ..... 2/209.3, 2/172, 184.5, 174, 171.4, 171.5, 209.4, 209.5, 2/209.7, 171, 175.1–175.9, 202, 206, 195.1–195.8
See application file for complete search history.

(56) References Cited

U.S. PATENT DOCUMENTS 1,036,004 A * 8/1912 Revell ..... 2/184.5
1,179,631 A * 4/1916 Hurd ..... 2/171.02
3,409,911 A * 11/1968 Loeb ..... 2/209.7
5,170,509 A 12/1992 Leopold
5,289,705 A 3/1994 Grimmer
5,511,249 A 4/1996 Higgins
5,598,585 A * 2/1997 Stroup ..... 2/171
5,644,799 A * 7/1997 Armenta et al. ..... 2/209.13
5,875,488 A 3/1999 Milani
5,875,494 A 3/1999 Garnier, Jr. et al.
6,711,749 B2 3/2004 White et al.
7,010,815 B2 * 3/2006 Tufano-Sisca ..... 2/209.3

* cited by examiner

*Primary Examiner*—Katherine Moran
*Assistant Examiner*—Sally C Cline
(74) *Attorney, Agent, or Firm*—Hughes Socol Piers Resnick & Dym Ltd.; Todd S. Parkhurst

(57) ABSTRACT

The present invention relates generally to hats, and more specifically to multi-function hats that provide the wearer with an enhanced sporting or fashion experience. The present invention pertains to an article of headwear with an integrated incision for maintaining and holding a portion of the wearer's hair outside the hat. This function is not only a fashion benefit but also is a safety function in that it keeps the wearer's hair away from the wearer's eyes by pulling the hair away from the wearer's face to the back of the head. The integrated incision also enables the article of headwear to stay on the wearer's head.

13 Claims, 3 Drawing Sheets

Fig. 3
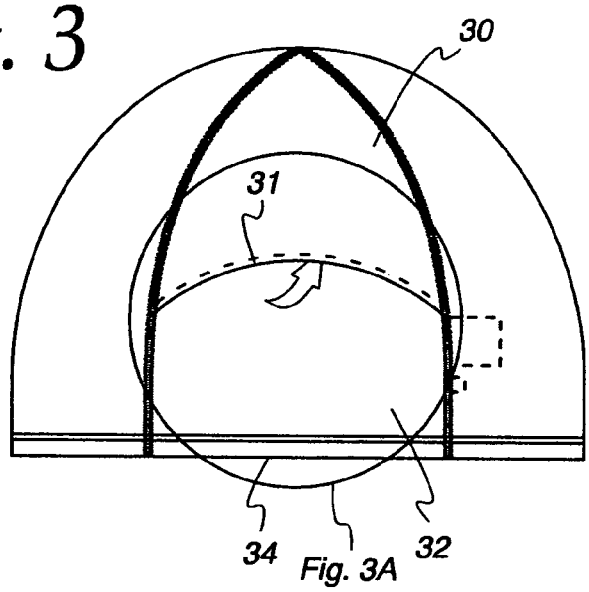
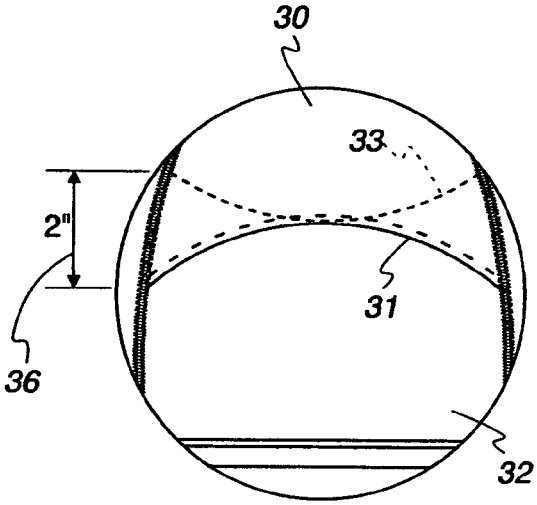
Fig. 3A
Fig. 4
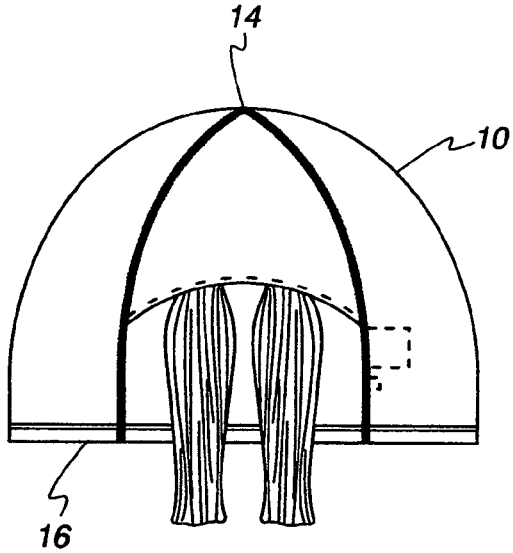

HEADGEAR WITH INTEGRATED HAIR SHIELDING MECHANISM

CROSS REFERENCE TO RELATED APPLICATIONS

This application claims the benefit of U.S. Provisional Application No. 60/663,802, filed on Mar. 21, 2005.

FIELD OF THE INVENTION

Hats of various styles and shapes have long been worn for protection and as a fashion accessory. Hats are often part of a coordinated outfit worn for some particular athletic activity such as skiing, snowboarding, jogging or the like. One problem is that when a wearer actively engages in physical or athletic activities of this type, the hat may become askew or may be entirely dislodged from the user's head. Furthermore, longer hair absorbs perspiration and becomes wet and uncomfortable next to the face and neck. Additionally the user's hair can obstruct the user's eyesight and become a hazard during activities.

The present invention relates generally to hats, and more specifically to multiple functions that provide the wearer with an enhanced sporting or fashion experience. The present invention pertains to an article of headwear with an integrated incision for maintaining and holding a portion of the wearer's hair outside the article of headwear. This function is not only a fashion benefit but also is a safety function in that it keeps the wearer's hair from obstructing the wearer's eyesight by pulling the hair away from the wearer's face and retaining the hair at the back of the head. The integrated incision in the headwear also enables the headwear to stay on the wearer's head. More particularly, the invention pertains to a beanie hat, cold weather hat or the like having the hair incision integrated into the material at the center back, upper center back or lower center back of the headwear. Furthermore, an integrated, overlapping incision is developed to allow the hat to maintain its warming function in keeping the wearer's head and therefore body warm.

It is a principle object of the present invention to provide a fashionable sports snow hat with a special function of allowing the user to secure their hair.

It is another object of the present invention to provide a beanie hat having an integrally attached functional incision construction with enough room to allow the user to secure his or her hair in a desired position.

It is another object of the present invention to provide a snow hat with an integrated incision construction that allows the user to keep their head and therefore body warm by either covering the secured hair with the top overlapping integrated material or keeping the head covered by insulating and covering the slit with the overlapping integrated material when the hair is not pulled out of the incision.

It is a primary object of the present invention to provide a fashionable sports apparel cap or hat item with an integrated incision construction for keeping long hair pulled away from the wearer's face and eyes.

The prior art has a great variety of caps and hats having apertures for accommodating a pony tail or hair of the wearer. Most of the prior art headwear that accommodates ponytails or hair are made of woven fabric in a "baseball" style cap and not a knitted style snow "beanie" or cold weather type hat.

Examples of "baseball" hats or headgear having apertures for accommodating hair or ponytails include Gamier, Jr. et al., U.S. Pat. No. 5,875,494, Leopold U.S. Pat. Nos. 5,170,509 and 5,239,705, Armenta, et al. U.S. Pat. No. 5,644,799 and Higgins U.S. Pat. No. 5,511,249 . These articles of woven "baseball cap" styles, as opposed to knitted headwear, utilize openings in which a ponytail or hair may be threaded. For example, Gamier, Jr., et al. U.S. Pat. No. 5,875,494 includes panels that may be opened and closed to accommodate hair or ponytails. These panels are vertically situated and have a closing device to seal them together. Armenta, et al. U.S. Pat. No. 5,644,799 includes headgear accessories that are installed by stitching or embroidering into an existing cap, hat or hood or other such article of headwear.

U.S. Pat. No. 5,875,488 to Milani ("Milani") pertains to an article of headgear having an elasticized aperture for receiving and providing a constrictive closure for a ponytail or other style of the wearer's hair. Milani, like U.S. Pat. Nos. 5,170,509 and 5,239,705 to Leopold, is not integrated into a knitted article.

U.S. Pat. No. 6,711,749 to White ("White"), shows an integrated hairband that is located in a seam or seamless construction that is located on the top crown of the head or the back top of the head. This invention is restrictive as to how the hair will fit through the band and is not made from a four-panel construction with two overlapping half ovals. White requires a sewn in hairband for holding the hair. This headwear does not maintain the warmth function with the circular hole allowing cold air to penetrate and warm air to be released when the hairband itself is not in use for holding the hair in a ponytail. It also does not keep the hair out of the wearer's eyes because the top of head pony tail is in proximity to the wearer's eyes and the unrestrained hair can obstruct their view.

SUMMARY OF THE INVENTION

The invention provides a fashionable and attractive article of headwear of the type generally used for snowboarding or jogging. It includes an integrated hair incision for fastening a portion or all of the wearer's hair, pigtails or ponytail outside of the article. The hair incision is integrated into the article of headwear and cooperates with the crown of the article of headwear by maintaining the article of headwear in a stable position on the wearer's head. The hair incision is also integrated so that the hat keeps the person's head and therefore body warm.

The article of headwear and more particularly a cold weather beanie type hat can be made in a half circle cone type shape having a four panel construction or standard stretch knit fit for engaging the wearer's head, ears and back of the neck. The back or back panel of the article has a secured overlap of the hat material that allows for a special hair incision that is integrated into the article. The incision provides a constricted aperture for the novel headwear. The hair, pigtail or ponytail of the wearer can be drawn through this incision so as to maintain the headwear in a desired position with respect to the hair and back of the wearer. The hair incision is also specially integrated into the headwear to keep the structure and function of the hat of keeping the head and body warm.

The described headwear may include seams, for example in the four-panel construction, where the seams create a curved effect that runs from the crown of the hat to the distal head opening to allow a snug fit for the head. Or it may have two or three, 2-3 inch crown seams that form an X at the top crown to allow for a form fitting hat shape. It could also have one seam from the crown to the distal head opening. It also may be a fully knitted construction.

The article of headwear with the integrated hair incision may include an elastic band which is sewn into the edges of the top and bottom overlaps of headwear and then secured to create the functional capability by sewing, clamping or otherwise fixing of the four ends, two each for top and bottom, on the right and left sides of the hair incision. Alternatively, the hair incision may be integrated into the material of the article by sewing the top and bottom overlaps, securing it to the right and left sides on the back panel or area of the article to provide a taut aperture for engaging the hair of the wearer in the functional hat. The hair incision may also be cut into the material without any separate top and bottom panels.

The headwear invention is constructed so that the wearer can choose his or her method of hair fashion and function in that the hair incision allows enough room to accommodate the wearer's own additional hair band in pigtails, a pony tail or braid. The taut hair incision is constructed of a top, overlapping layer material that is sewn in a half oval shape and secured on both the left and right side of the furthest or central point of the oval. There is also a bottom layer of under lapping material that is sewn in a half oval shape in the opposite direction as the top oval so as to form a fully covered incision that can accommodate and secure hair that is brought through it. The bottom layer is also tightly secured by each of two furthest points on the right and left sides. The overlap of both the top and bottom material is preferably two inches on both the right and left sides to ensure the best head coverage for warmth, the best hole for the hair to be pulled through and the most room to allow different types of hair styles. These overlaps can also be two overlapping half ovals that are oriented in the same direction, either up or down, or even a straight cut as opposed to ovals.

BRIEF DESCRIPTION OF THE DRAWINGS

FIG. 3 shows the upper crown panel formed into a 'frowning' half oval overlap. The lower bottom panel is formed into a 'smiling' half oval under lap. Together these panels are sewn overlapping each other (FIG. 3A) with, preferably, a two-inch separation 36 on both the right and left side seams of the half ovals.

FIG. 4 is a rear view illustration of FIG. 1.

DETAILED DESCRIPTION OF THE INVENTION

Typically the distinction between a woven article and a knitted article has been that woven articles are generally formed with a set of weft and a set of warp threads that are interlaced to form the end article. Knitted articles, on the other hand, are formed from a single length of thread or yarn or multiple types or colors of yarn that are looped together to form the end knitted article having different colors, densities and stretch characteristics.

The invention is applicable to either woven or knit articles where the woven or knit article includes an integrated hair incision that is constructed in accordance with the invention. The integrated hair incision is best made by two overlapping half ovals that are secured by two seams that join the knitted article to form the article of headwear of the invention. One seam is on each the right and left side of the half ovals to ensure a tight and functional construction. The invention can also be made without seams, for example with only stitches, one on the right and one on the left, securing the overlapping half ovals.

Figure 1:
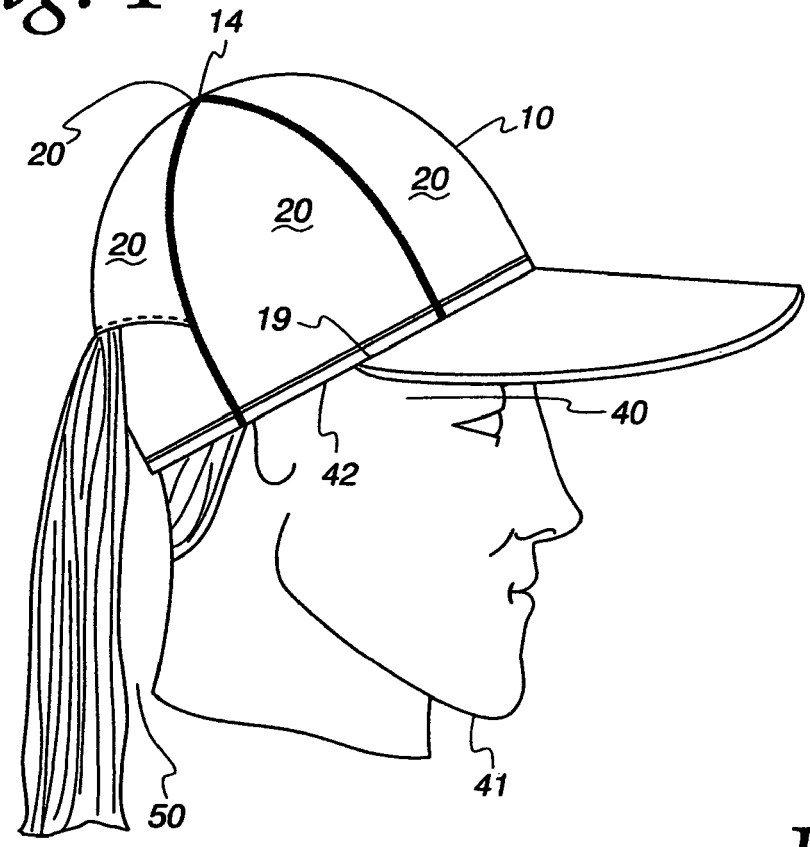
FIG. 1 is a schematic illustration of one embodiment of the present invention showing a beanie-type headgear.
Figure 2:
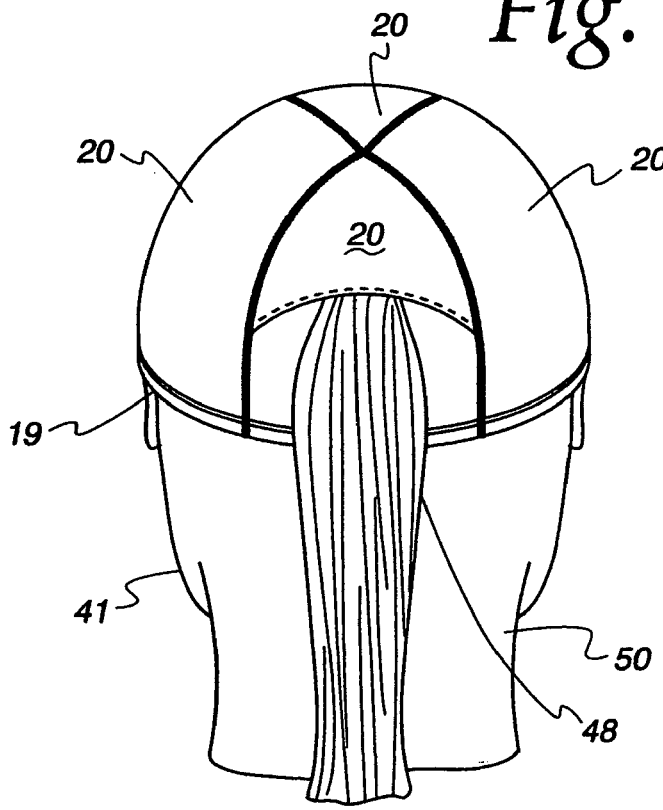
FIG. 2 is a rear view illustration of FIG. 1, wherein a person's hair is pulled through an incision comprising two half ovals (shown is the outer half oval upper panel material cut in an downward concave shape).

A preferred embodiment of the invention is shown in FIGS. 1 and 2, wherein a novel article of headwear 10 in the form of a cold weather snow hat is illustrated as the best mode of the invention. The article of headwear 10 can be constructed by hand or by knitting machines capable of forming concave or convex or flat articles and preferably articles having a crown end 14 and a proximal end 16. Preferably the headwear 10 includes four seamed panels 20 sewn from the top of the crown to the proximal head opening for tightly fitting over the head 40 of wearer 41. Article of headwear 10 is generally worn to cover a portion of forehead 40 along with ears 42 and a portion of the back of the neck 50.

Unfortunately, the volume of hair 48 (see FIG. 2) inside ordinary articles of headwear, in conjunction with the strenuous activity of the wearer, causes the hair to become damp or wet and uncomfortable during the activity. The hair can also cause the ribbed, tight knit or elasticized headband portion 19 of the article of headwear 10 to move upward on the head of the wearer 41 or even become dislodged. The hair can also become a hazard by getting into the face and eyes of the wearer, thus obstructing the wearer's view. The amount of activity and volume of hair underneath the hat determines the amount of discomfort, movement and obstruction.

Figure 5:
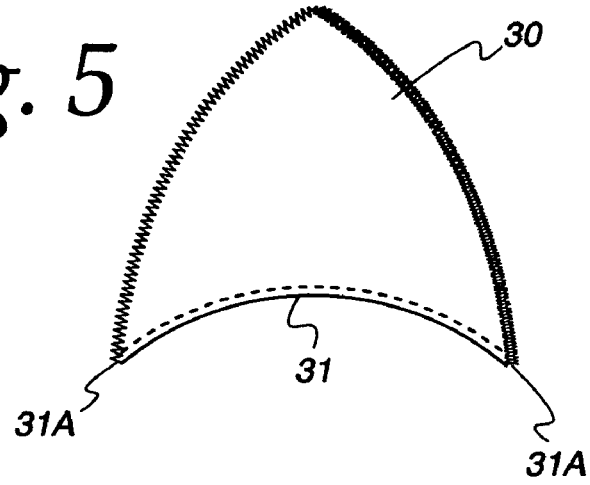
FIG. 5 shows an upper crown panel formed into a frowning half oval for overlapping a lower panel.
Figure 6:
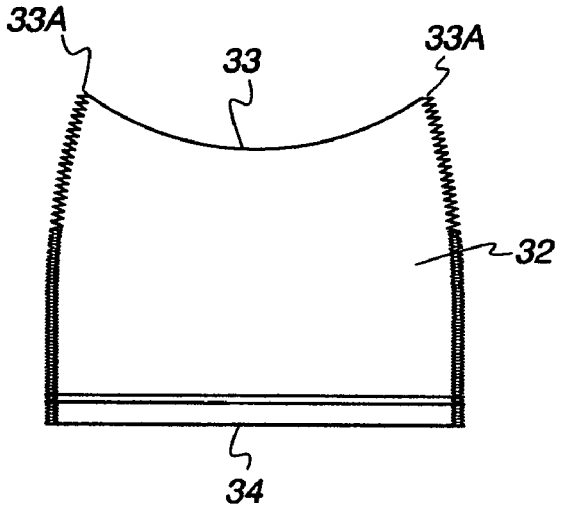
FIG. 6 shows a lower bottom panel formed into a smiling half oval for underlapping an upper crown panel (FIG. 6A).
Figure 6A:
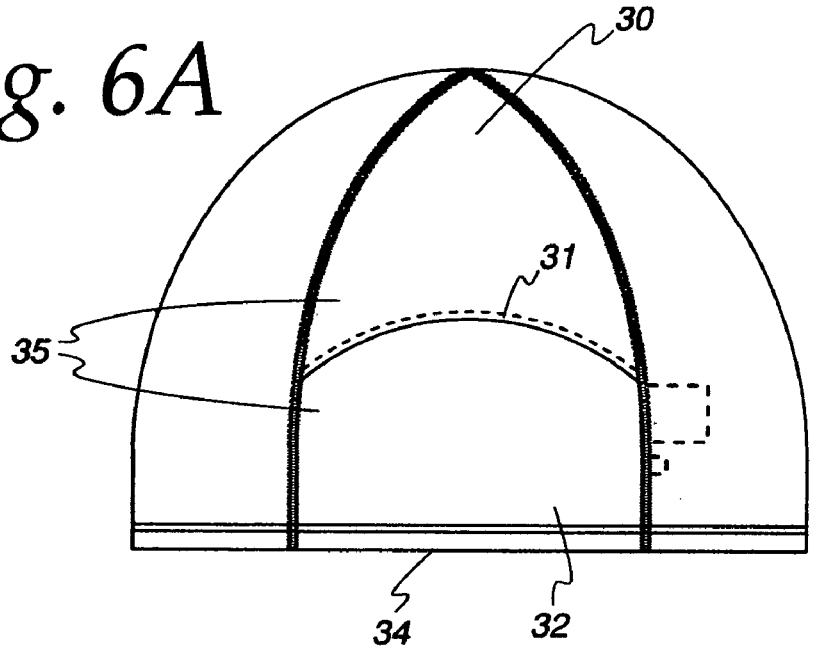

The headwear of the present invention can be made by creating two overlapping pieces in and on the back panel 35. (see FIGS. 5 and 6) to form a hair incision. The upper crown panel 30 is formed into a 'frowning' half oval overlap 31 at the proximal end 31 of the panel. The lower bottom panel 32 is formed into a 'smiling' half oval under lap 33 at the distal end 33 of the bottom 32 panel. Together these panels (FIG. 3) are sewn overlapping each other (FIG. 3 A) with, preferably, a two-inch separation 36 on both the right and left side seams of the half ovals so that the 'frowning' half oval 31 is secured on the right and left seams 31 A below the 'smiling' 33 half oval ends 33A. The half oval upper panel material may be cut in a downward convex shape and the half oval lower panel material may be cut in an upward convex shape. Alternatively, the half oval upper panel material may be cut in a downward concave shape and the half oval lower panel material may be cut in an upward concave shape.

In either case, the integrated hair incision is made of two overlapping half oval panels 31, 33. These panels are integrated, by sewing or other known means into the headwear 10, either at the center back or lower center back (FIG. 4) of the article 10. Here, the panels 31, 33 are attached by full panel seams coming from top crown 14 to distal edge 16; and they join the half oval panels 30, 32 to the rest of the knitted article to form the headwear 10.

The novel articles of the invention with the integrated hair incision provide a supportive interrelationship between the hair incision and the headwear (FIG. 4). The invention allows the hair to be pulled through the hair incision in a manner that maintains the stability of the hat on the wearer's head. Further it allows the wearer to pull the hair back away from the face and eyes for comfort from hair dampness, and to minimize eyesight obstruction during increased activity. It allows complete flexibility as to how the wearer wants to fix the hair in pig tails, a pony tail, braid or otherwise. The construction also keeps the head warm by the overlapping, snug combination.

The present invention thereby provides an exciting solution for active people with longer hair. It not only provides multiple functions and solves multiple problems for the wearer but also offers an attractive, hip look.

It is to be understood that the present invention is not limited to the embodiments described above, but encompasses any and all embodiments within the scope of the following claims.

We claim:

1. An article of headwear comprising:

an article of material having a crown top end and a proximal edge;

four seamed material panel edges extending from the crown top to the proximal edge forming said crown top and said proximal edge; and an incision consisting of two overlapping pieces of the panel material, two overlapping pieces of material comprising an upper panel consisting of a half oval shape and a lower panel consisting of a half oval shape, wherein the upper panel overlaps the lower panel and the lower panel underlaps the upper panel, wherein hair can be pulled through an incision formed by the overlapping pieces and wherein the proximal edge provides an opening for a person's head.

2. The article of claim 1, wherein the material is a woven material.

3. The article of claim 1, wherein the material is a knitted material.

4. The article of claim 1, further comprising a visor.

5. The article of claim 1 wherein the overlapping upper panel and underlapping lower panel are each secured by right and left seams to a panel extending from the crown to the proximal edge.

6. The article of claim 1, wherein the upper and lower panels are half ovals.

7. The article of claim 6, wherein the half oval upper panel material has a downward convex shape and the half over panel material has an upward convex shape.

8. The article of claim 1, wherein the upper and lower panels are fonned from flat material.

9. An article of headwear comprising:

an article of material having a crown top end and a proximal edge;

and at least two half oval panel pieces of material wherein the two half oval pieces comprise a half oval upper panel and a half oval lower panel, each piece defining at least one panel edge extending from the crown top to the proximal edge;

one of the pieces of material overlapping at least partly the other piece of material to define an incision through which hair can be pulled, wherein the proximal edge provides an opening for a person's head.

10. An article of head wear according to claim 9 wherein the material is a woven material.

11. An article of headwear according to claim 9 wherein the material is a knitted material.

12. An article of headwear according to claim 9 further including a visor.

13. An article of headwear according to claim 9 wherein said half oval upper panel has a downward convex shape and said half oval lower panel has an upward convex shape.

* * * * *